United States Patent [19]

Orlando

[11] Patent Number: 4,839,941

[45] Date of Patent: Jun. 20, 1989

[54] ELEVATING AND TRAVERSING HOOD HINGE

[75] Inventor: James A. Orlando, Troy, Mich.

[73] Assignee: Ford Motor Company, Dearborn, Mich.

[21] Appl. No.: 138,106

[22] Filed: Dec. 28, 1987

[51] Int. Cl.[4] ..... E05D 15/22

[52] U.S. Cl. ..... 16/361; 16/346; 16/368; 180/69.21

[58] Field of Search ..... 16/346, 348, 360, 361, 16/366, 368, 370; 180/69.21

[56] References Cited

U.S. PATENT DOCUMENTS 3,225,856 12/1965 Caramanna .
4,069,550 1/1978 Silk et al. ..... 180/69.21 X
4,125,170 11/1978 Botz .
4,206,944 6/1980 Kumagai et al. ..... 180/69.21 X
4,727,621 3/1988 Emery et al. ..... 180/69.21 X

FOREIGN PATENT DOCUMENTS 3515099 10/1986 Fed. Rep. of Germany ... 180/69.21

*Primary Examiner*—Fred A. Silverberg
*Attorney, Agent, or Firm*—Daniel M. Stock; Clifford L. Sadler

[57] ABSTRACT

An improved automotive hood hinge has a pair of plates fixed to the hood and the body, one mounting a fixed pivot pivotally and translationally engaging a slot formed on the other. A single stabilizing link controls the simultaneous pivotal and translational movement of the hood during opening and closing.

1 Claim, 2 Drawing Sheets

ELEVATING AND TRAVERSING HOOD HINGE

BACKGROUND OF THE INVENTION

The present invention relates generally to hinges and more specifically to hinge arrangements for the hood of other closure panels of an automotive vehicle body.

DESCRIPTION OF THE PRIOR ART

To cover and selectively provide access to the engine compartment of an automotive vehicle, it is well known to mount a covering hood for pivotal movement with respect to the remainder of the body of the vehicle on a pair of hinges positioned on opposite lateral sides of the vehicle adjacent the rear of the front fenders. Providing clearance space for the portions of the hood near the hinge positions during the pivotal movement between closed and opened positions provides a significant packaging problem to the automotive designer. There are often functional components of the vehicle positioned near the rear edge of the hood and the clearance between the side edges of the hood and the adjacent fenders may be extremely limited.

Because of this, simple pivotal movement of the hood with respct to the remainder of the vehicle body must be sometimes avoided so that sufficient clearance during pivotal movement can be maintained. One exemplary approach to providing more complex movement is that shown in U.S. Pat. No. 3,225,856 to Caramanna in which a movable pivot bearing is utilized to permit foward movement of the rear edge of the hood. Another approach is illustrated in U.S. Pat. No. 4,206,944 to Kumagai et al. In this hinge arrangement, a spring loaded sliding pivot provides forward movement of the hood, and a swans-neck connection between the pivot and the hood itself provides a certain amount of upward movement. Yet another example of the solutions to the design packaging problem illustrated in the prior art is that shown in U.S. Pat. No. 4,125,170 to Botz. In Botz, a swans-neck link between the pivotal mount to the body and the hood is likewise used but the link is pivotally connected at both ends to allow a compound movement of the hood.

All of the prior art solutions have been found to be disadvantageously complex, particularly in the use of multiple pivot mechanisms. These may result in imprecise action of the hinge and is some cases may produce instability during opening and closing and cause installation problems in the assembly of the vehicles. These problems can ultimately result both in flutter or vibratory movement of the hood during use and less than optimal fits of the hoods with adjacent body panels.

SUMMMARY OF THE INVENTION

Responsive to the deficiencies in the prior art, it is an object of the present invention to provide a simple economically producible hood hinge which effects forward and upward movement of the hood during pivotal opening movement.

According to a feature of this invention, the object is accomplished thorugh the provision of a threelink hood hinge having a fixed pivot carried on the vehicle body, a slotted hinge plate on the hood, and a stabilizing rod interconnecting a hinge plate on the body and the hinge plate on the hood.

BRIEF DESCRIPTION OF THE DRAWINGS

This object and feature, as well as other objects and features, will become apparent to those skilled in the automotive body arts upon reading the following description with reference to the accompanying drawings in which.

DESCRIPTION OF THE PREFERRED EMBODIMENT

Figure 1:
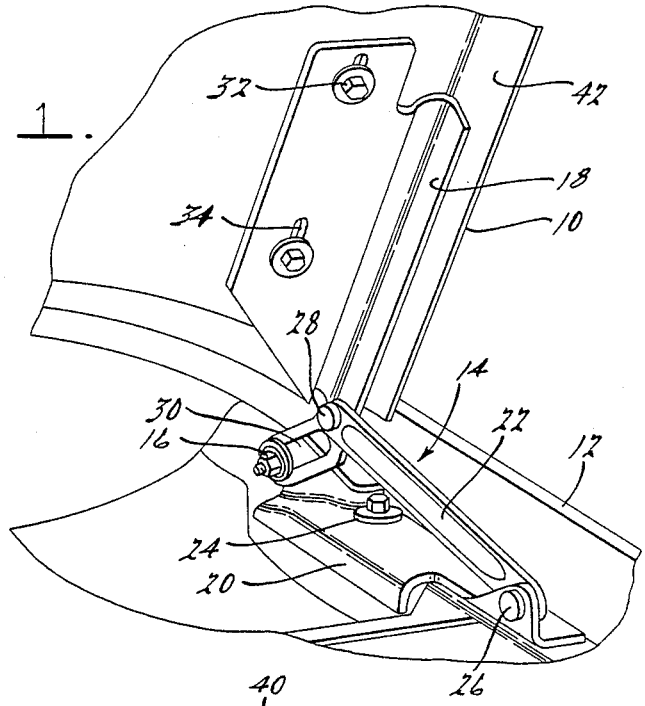
FIG. 1 is a perspective view of a part of an automobile in which a hinge of the present invention is installed.

A portion of the body of an automotive vehicle is illustrated in FIG. 1 as including a hood 10 and a fender 12 with a hinge assembly indicated generally at 14 operatively disposed between the hood 10 and the fender 12. The hinge assembly 14, which may be duplicated on the other side of the vehicle, comprises a main pivot bolt 16, a hood plate 18, a body plate 20, and a stabilizing bar 22.

The body plate 20 is fixedly secured to a portion of the vehicle body, such as the fender 12, through suitable mechanical fastening means such as a bolt 24. The body plate 20 is further connected to the stabilizer rod 22 in a pivotable fasion, as through the pin indicated at 26. A similar pivot pin connection 28 at the other end of the stabilizing rod 22 effects connection to the hood plate 18. A slot 20 is formed through a portion of the hood plate 18 extending obliquely upwardly from the horizontal plane of the hood 10 in its closed position. The slot 30 receives the main pivot bolt 16, which is preferably formed as a conventional shoulder bolt received in the slot 30, in close sliding fit relationship. The hood plate 18 is secured to the hood 10 by suitable fasteners such as bolts 32 which are preferably received in slots 34 extending forwardly and rearwardly along the hood 10. This attachment arrangement permits adjustment of the forward and rearward position of the hood 10 during assembly of the hood 10 to the vehicle so that the desired fit between hood 10 and fender 12 as illustrated in FIG. 2 may be accomplished.

Figure 2:
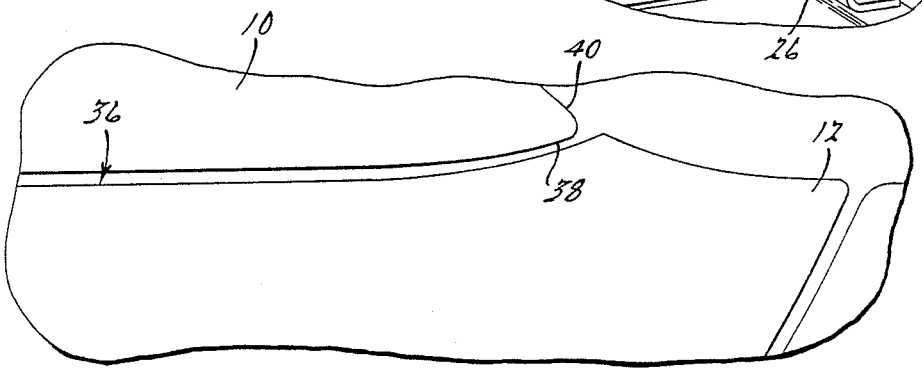
FIG. 2 is a top view of a portion of an automobile body illustrating the interface between a hood and an adjacent fender with the hood in a closed position.

From reference to FIGS. 1 and 2, it can be appreciated that for a close fitting relationship such as illustrated, and particularly for one in which the inboard edge 36 of the fender 12 and the outboard edge 38 of the hood 10 curve inwardly toward the center of the vehicle, that simple pivotal movement about any axis positioned forwardly of the rear edge 40 of the hood may cause vertically extending portions of the hood 10 such as that illustrated by a wall 42 in FIG. 1 to interfere with adjacent portions of the fender 12. The hinge assembly 14 of the present invention avoids this interference condition as well as others which may exist in the engine compartment of the vehicle by effecting movement such as that illustrated in FIGS. 3 and 4.

Figure 3:
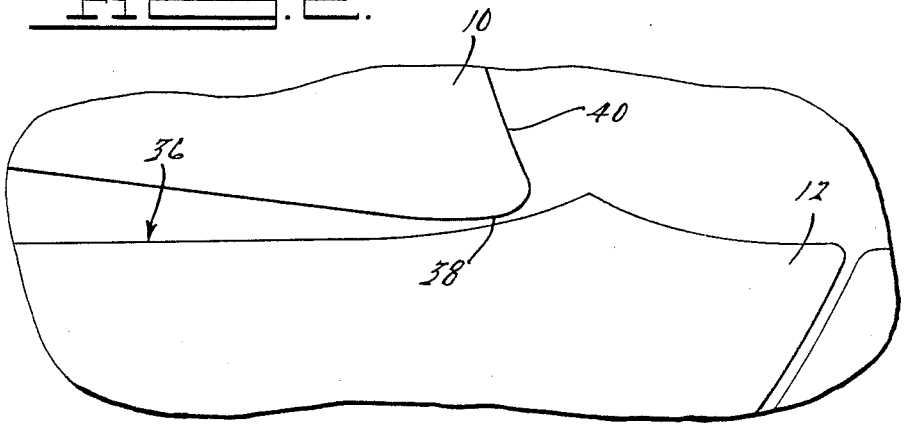
FIG. 3 is a top view similar to FIG. 2 showing a changed hood position after opening as controlled by the hinge of the present invention.

Movement effected through the hinge assembly 14 as can be seen in FIG. 3 in exaggerated form tends to move the rear edge 40 of the hood 10 forwardly away from the point of potential interference. As can best be seen in FIG. 4, the hinge 14 also cooperates to provide movement of the hood 10 upwardly as it moves forwardly during opening.

Figure 4:
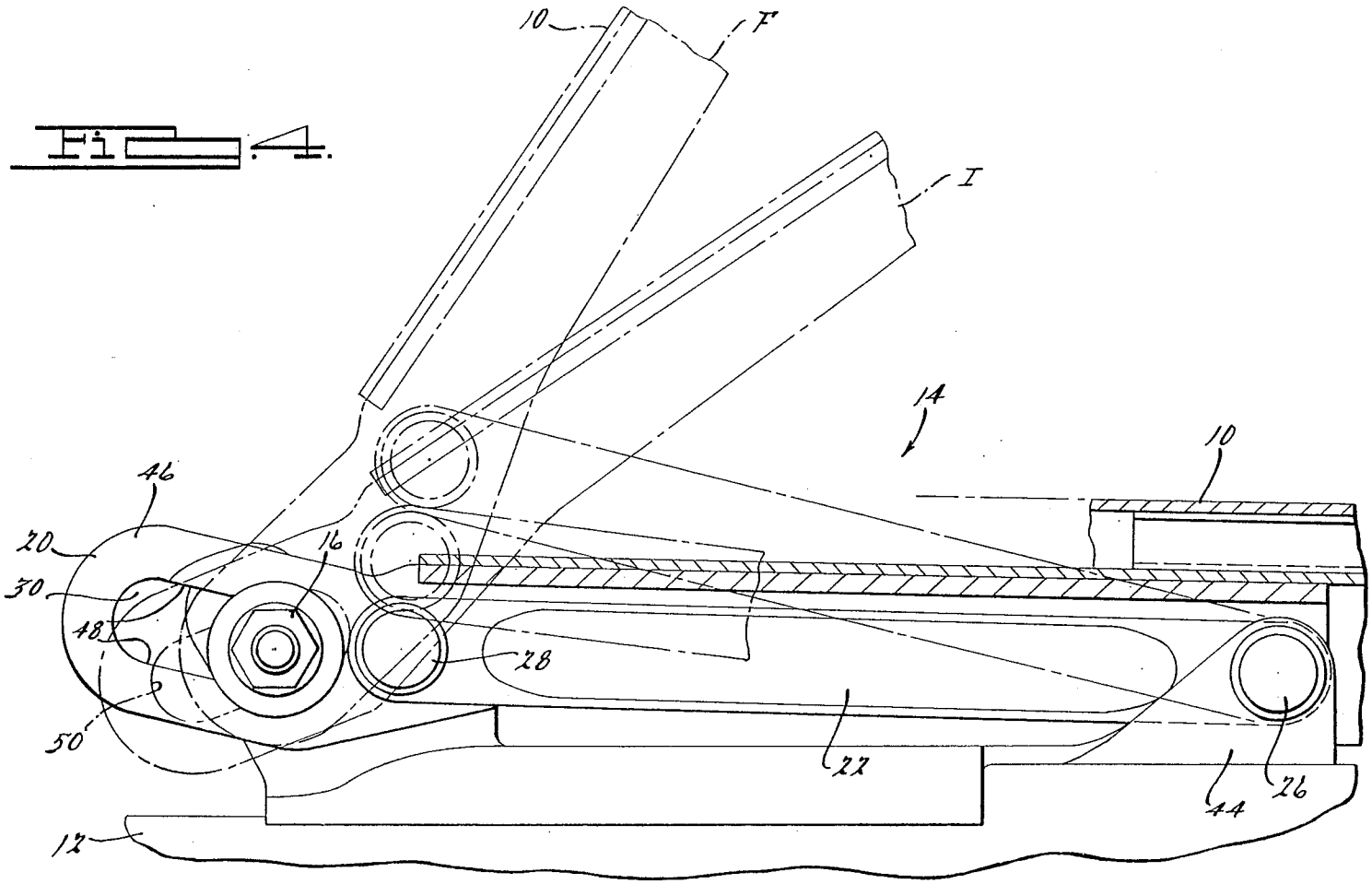
FIG. 4 is a side view of the hinge of FIG. 1.

Turning now to FIG. 4, the relationship of the components of the hinge assembly 14 through which the desired motion is accomplished may be better appreciated. It can be seen that the stabilizing rod 22 is pivotally carried on the body plate 20 at a forwardly positioned upstanding ear 44 by operation of the pin connection indicated at 26. Pivotal connection with the hood plate 18 through the pin 28 is effected at a position forward of the slot 30. In the preferred embodiment illustrated, the slot 30 extends upwardly and rearwardly (as viewed in the closed solid line position of FIG. 4); but it will be appreciated that the extending direction of the slot 30 may be modified to yield a variety of hood motions during opening. The pivot receiving portion 46 of the hinge plate 18 may, in fact, be formed in a variety of configurations responsive to the clearance avoidance needs of the designer.

As the hood 10 is moved from the full line closed position of FIG. 4 to the intermediate and fully opened positions shown in dotted line and labeled "I" and "F", respectively, the hood plate 18 pivots about the main pivot bolt 16, which is engaged by the sides 48 of the slot 30. This pivoting movement, of course, tends to raise the location of the pivot pin 28 operatively connecting the hood plate 18 and the stabilizer rod 22. The pin 28, however, is constrained to move in an arc defined by the length of the stabilizer rod 22 rotating about the pivot pin 26. This causes the hood plate 18 to be drawn forwardly and upwardly following the pivot pin 28 and drawing the pivot engaging portion of the hood plate 18 along the path of the slot 30 sliding along the sides 48 while rotating occurs. Travel of the hood 10 is limited as the main pivot bolt 16 abuttingly engages the end wall 50 of the slot 30.

While only one embodiment of the invention hood assemlby has been described, others may be possible without departing from the scope of the appended claims.

I claim:

1. A hinge assembly for controlling movement of a hood between closed and opened position with respect to an automotive vehicle body comprising:

a first plate having a first end and a second end and being secured to the body;

a pivot bolt secured to the first plate at the first end thereof;

a second plate having a first end and a second end and being secured to the hood;

means defining an elongated slot in the second plate for receiving the pivot bolt for permitting simultaneous pivotal and translation movement with respect thereto while simultaneously permitting upward and forward movement of the hood with respect to the body; and an elongated stabilizing rod pivotally connected at one end to the first plate at the second end of the first plate and pivotally connected at its other end to the second plate at the first end of the second plate, the other end pivotal connection being located at one end of the slot while also being inbetween the slot and an edge of the hood, said elongated slot being located at the first end of the second plate while also being spaced outwardly from and at an angle to the edge of the hood.

* * * * *